US007618132B2

(12) United States Patent
Wilson et al.

(10) Patent No.: US 7,618,132 B2
(45) Date of Patent: Nov. 17, 2009

(54) APPARATUS AND METHOD FOR PREVENTING DAMAGE TO PRINTING SYSTEMS

(75) Inventors: Rhonda L. Wilson, Corvallis, OR (US); Ronald J. Ender, Corvallis, OR (US); Craig L. Malik, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 338 days.

(21) Appl. No.: 11/364,636

(22) Filed: Feb. 28, 2006

(65) Prior Publication Data

US 2007/0200904 A1 Aug. 30, 2007

(51) Int. Cl.
*B41J 2/175* (2006.01)

(52) U.S. Cl. ..... 347/84; 347/86; 347/85

(58) Field of Classification Search ..... 347/84, 347/85, 86

See application file for complete search history.

(56) References Cited

U.S. PATENT DOCUMENTS 4,714,937 A 12/1987 Kaplinsky
5,774,154 A * 6/1998 Underwood ..... 347/85
6,692,116 B2 2/2004 Pan et al.
6,874,872 B2 4/2005 Lewis et al.
2002/0118248 A1 8/2002 Inoue et al.
2002/0145650 A1* 10/2002 Pan et al. ..... 347/85
2003/0227520 A1* 12/2003 Yamanaka et al. ..... 347/85
2003/0227521 A1 12/2003 Pan et al.
2004/0100540 A1* 5/2004 Hatasa et al. ..... 347/86
2004/0135853 A1* 7/2004 Netsu et al. ..... 347/85
2005/0200669 A1 9/2005 Timm et al.
2005/0212878 A1 9/2005 Studer et al.
2005/0225613 A1 10/2005 Namekawa et al.

* cited by examiner

*Primary Examiner*—Manish S Shah
*Assistant Examiner*—Laura E Martin

(57) ABSTRACT

Damage is prevented in printing systems by allowing fluid from the printing system's fluid delivery system to expand. In one embodiment, this is accomplished by fluidly connecting a fluid expansion receptacle to the fluid delivery system. The fluid expansion receptacle provides volumetric compliance so that if printing fluid in the system expands, such as due to freezing, the fluid is able to expand into the fluid expansion receptacle and not damage the printing system.

20 Claims, 7 Drawing Sheets

APPARATUS AND METHOD FOR PREVENTING DAMAGE TO PRINTING SYSTEMS

BACKGROUND OF THE INVENTION

Inkjet printing technology is used in many commercial products such as computer printers, graphics plotters, copiers, and facsimile machines. One type of inkjet printing, known as "drop on demand," employs one or more inkjet pens that eject drops of ink onto a print medium such as a sheet of paper. The pen or pens are typically mounted to a movable carriage that traverses back-and-forth across the print medium. As the pens are moved repeatedly across the print medium, they are activated under command of a controller to eject drops of ink at appropriate times. With proper selection and timing of the drops, the desired pattern is obtained on the print medium.

An inkjet pen generally includes at least one drop-generating device known as a printhead, which has a plurality of nozzles or orifices through which the drops of ink are ejected. Adjacent to each nozzle is a firing chamber that contains the ink to be ejected through the nozzle. Ejection of an ink drop through a nozzle may be accomplished using any suitable ejection mechanism, such as thermal bubble or piezoelectric pressure wave to name a few. Ink is delivered to the firing chambers from an ink supply. The ink supply can be wholly contained within the pen body. Such an ink supply is considered to be "on-board" as the whole ink supply is carried on the carriage. With this arrangement, the entire pen, including the printhead, is replaced when the ink runs out.

In "off-board" or "off-axis" printing systems, the ink supply can comprise a stationary ink container located separately from the pen. The ink container is fluidly coupled to a chamber in the pen body via a fluid delivery system, which typically includes flexible tubing. Printing fluids other than ink, such as preconditioners and fixers, can also be provided. Off-axis printing systems often include multiple ink or fluid containers and multiple pens and printheads. The stationary position and relatively easy access of an off-axis supply can allow for relatively large volumes of printing fluids to be stored and delivered. The use of replaceable fluid containers that are separate from the printhead allows the containers to be replaced without replacing the printhead. The printhead is then replaced at or near the end of printhead life, and not whenever a container is replaced. An off-axis supply also provides for a lighter pen and carriage assembly. This generally requires relatively less energy to move, while moving faster, quieter, and/or with less vibration.

A concern with printing systems is that during shipping the system can be exposed to freezing temperatures, which could cause printing fluid in the system to freeze. Because most printing fluids contain water, they expand when freezing. This expansion can damage the fluid delivery system, such as causing the tubing to burst. One approach to avoiding such damage is to ship the printing systems without printing fluid. However, this approach creates certain logistical problems. For one, it is usually desirable to test a printing system at the factory prior to shipping to a customer. Such testing requires that the printing system be fully wetted. However, it is difficult and not cost efficient to wet a new printing system, test it, and then remove all of the printing fluid prior to transportation. Also, the occasion may arise where the user needs to return the printing system, such as for service or at the end of a lease. In this case, it is impractical to drain the printing fluid from the system prior to reshipment.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
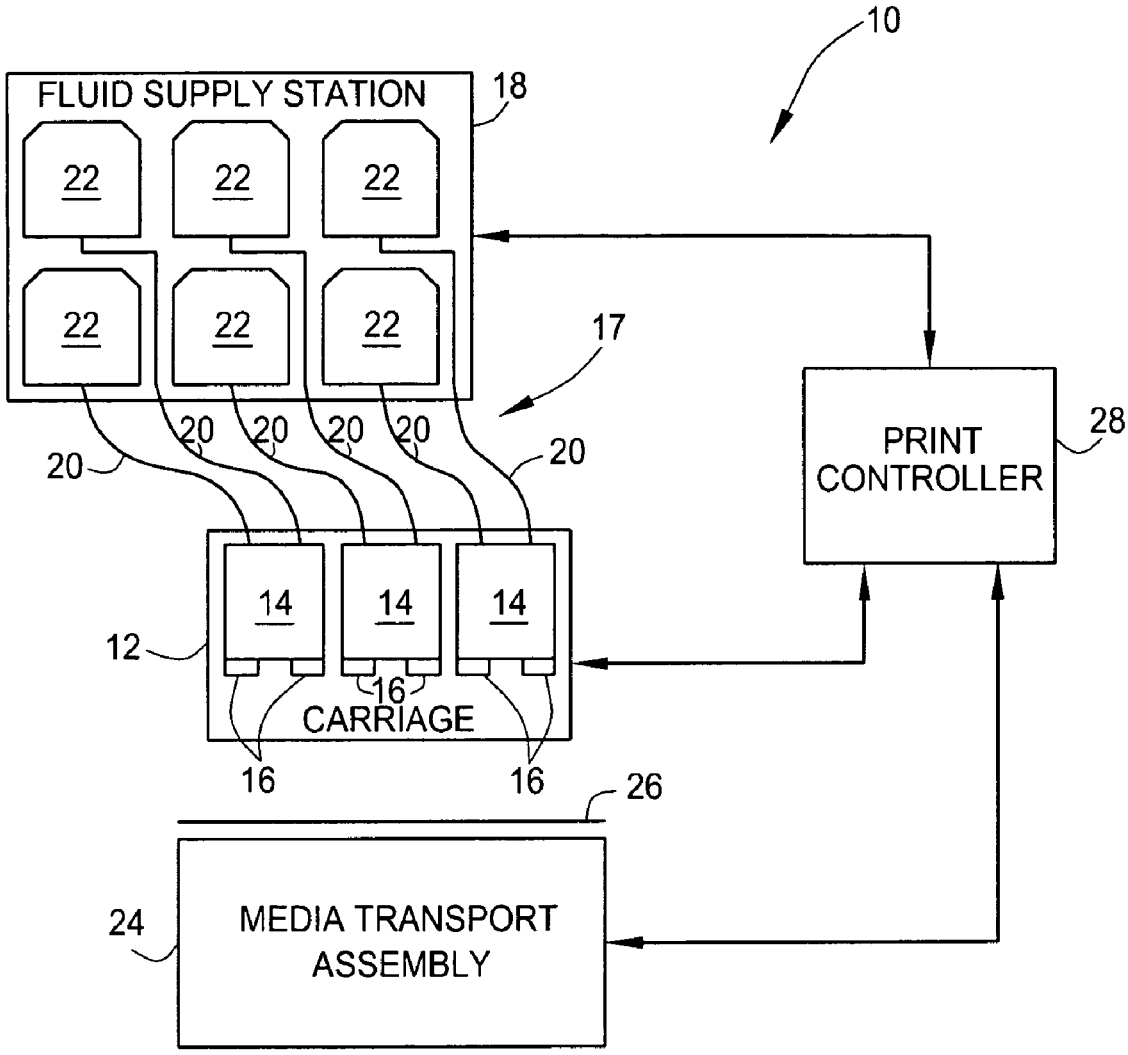
Fig. 1 (Prior Art)
FIG. 1 is a schematic block diagram depicting a conventional inkjet printing system.

Referring to the drawings wherein identical reference numerals denote the same elements throughout the various views, FIG. 1 shows a conventional inkjet printing system 10. As used herein, the term "printing system" is intended to encompass any system or device that prints on a print medium (i.e., produces hard copy). Such devices include, but are not limited to, computer printers, graphics plotters, copiers, facsimile machines and the like. Furthermore, the term "inkjet printing system" refers to any device that uses inkjet technology for producing hard copy.

The inkjet printing system 10 includes a print carriage 12 that includes receiving stations or bays for supporting one or more inkjet pens 14. In the illustrated embodiment, each inkjet pen 14 includes at least two printheads 16 that eject drops of printing fluid through a plurality of orifices or nozzles formed therein. As used herein, the term "printing fluid" refers to any fluid used in a printing process, including but not limited to inks, preconditioners, fixers, etc. The inkjet pens 14 are fluidly coupled to a fluid delivery system 17 that includes a fluid supply station 18 and one or more supply tubes 20. The fluid supply station 18 includes one or more fluid containers 22 that hold various printing fluids which can be pressurized or at atmospheric pressure. The supply tubes 20 are typically made of a flexible material.

By way of example only, the printing system 10 is shown to have six fluid containers 22 and three inkjet pens 14. In this case, each pen 14 is connected to two of the fluid containers 22 via a pair of corresponding supply tubes 20, and the pens 14 are configured so that each of the two printheads 16 is in fluid communication with a different one of the two fluid containers 22. Alternatively, the printing system 10 could be configured to have an equal number of inkjet pens 14 and fluid containers 22. In such case, each pen 14 would be connected to a corresponding one of the fluid containers 22 via a respective one of the supply tubes 20.

The printing system 10 also includes a media transport assembly 24 that is positioned relative to the carriage 12 so as to define a print zone adjacent to the printhead nozzles. The media transport assembly 24 positions a print medium 26, such as paper, card stock, transparencies or the like, in the print zone so that drops of printing fluid ejected by the printheads 16 are directed toward the print medium 26. In one embodiment, the carriage 12 is a scanning carriage that traverses the inkjet pens 14 back-and-forth across the print medium 26. Typically, the printhead nozzles are arranged in one or more columns or arrays such that properly sequenced ejection of printing fluid causes characters, symbols, and/or other graphics or images to be printed on the print medium 26 as the print carriage 12 and the print medium 26 are moved relative to each other.

The print carriage 12, the inkjet pens 14, the fluid containers 22 and the media transport assembly 24 are electrically interconnected to a print controller 28 that controls various system functions. The controller 28 receives data from a host system (not shown) and includes memory for temporarily storing the data. The data defines a print job for the inkjet printing system 10 and includes one or more print job commands and/or command parameters. In response to the data, the controller 28 provides control of the inkjet pens 14, including timing control for ejection of ink drops from the printhead nozzles. The controller 28 also controls the carriage drive system and the media transport assembly 24 to provide the desired relative positioning of the printhead nozzles and the print medium 26.

Figure 2:
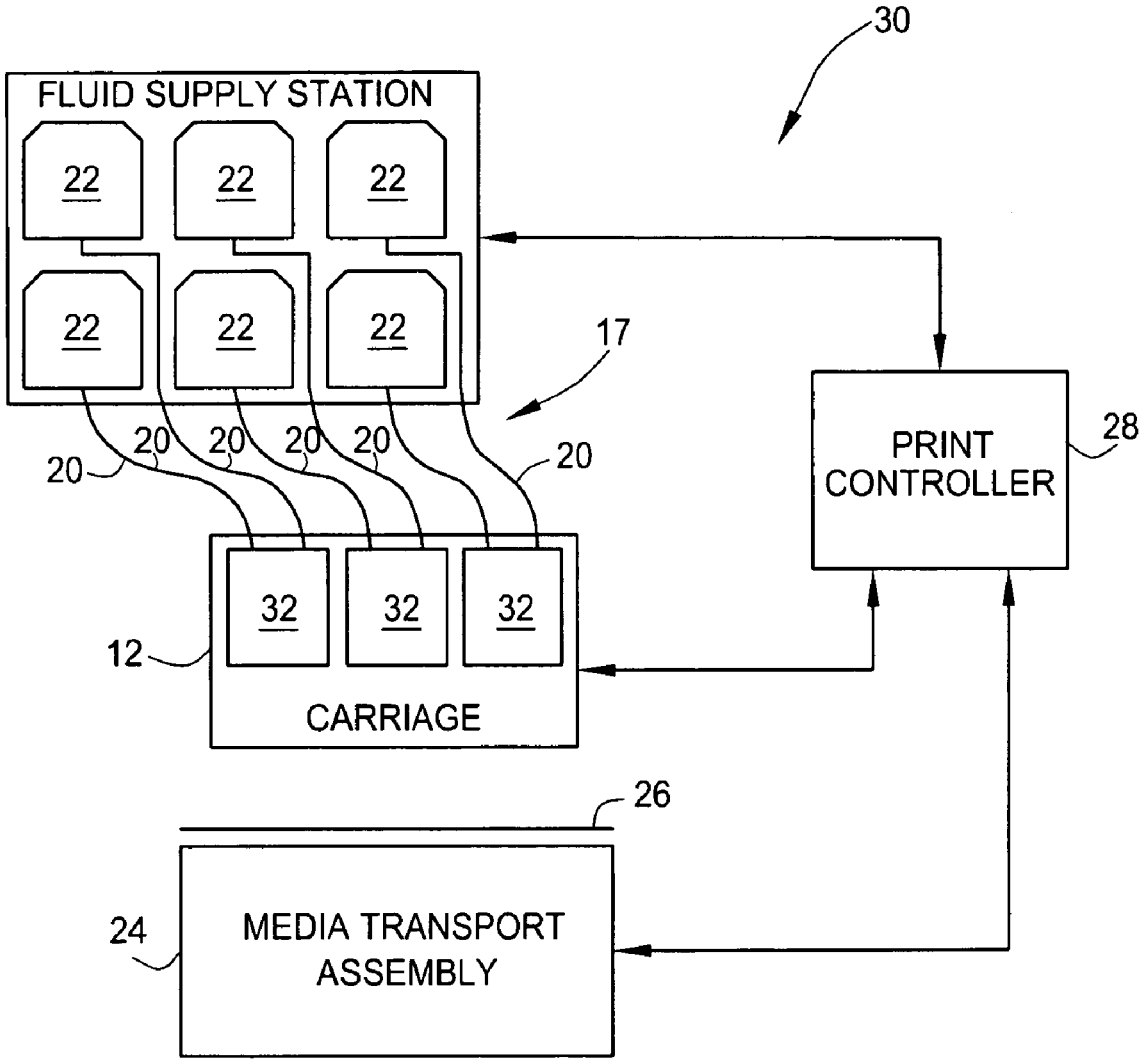
FIG. 2 is a schematic block diagram depicting one embodiment of an apparatus including a printing system and fluid expansion receptacles.
Figure 3:
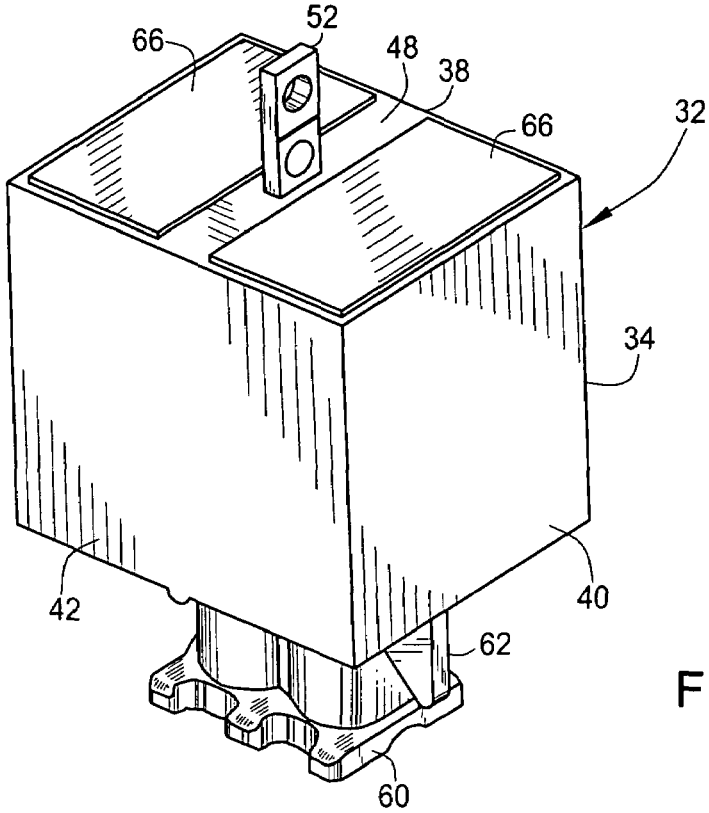
FIG. 3 is a perspective view of one embodiment of a fluid expansion receptacle.
Figure 4:
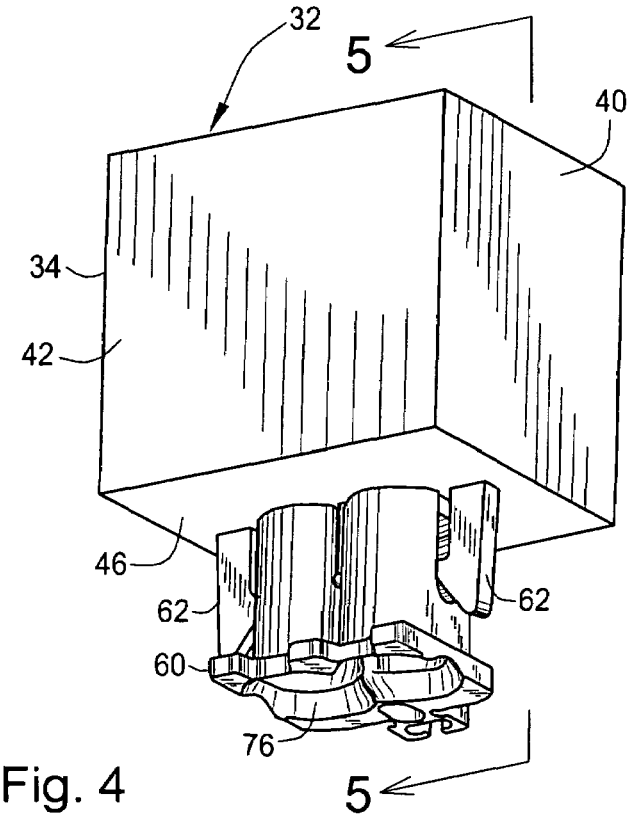
FIG. 4 is another perspective view of the fluid expansion receptacle of FIG. 3.

FIG. 2 shows one embodiment of an apparatus 30 that includes a printing system, such as the inkjet printing system 10 depicted in FIG. 1, and one or more fluid expansion receptacles 32 that are fluidly connected to the fluid delivery system 17 in place of the inkjet pens 14. The fluid expansion receptacles 32, which are described in more detail below, provide volumetric compliance so as to allow fluid from the fluid delivery system 17 to expand. This allows printing fluid to expand without damaging the printing system 10 when the apparatus 30 is exposed to environments in which the printing fluid could freeze.

Unlike the inkjet pens 14, the fluid expansion receptacles 32 are not capable of ejecting drops of printing fluid. Thus, the apparatus 30 is incapable of printing. For this reason, the pens 14 generally are replaced with the fluid expansion receptacles 32 only in circumstances in which the printing system will not be used for printing and possibly could be subjected to freezing temperatures. Such circumstances include, but are not necessarily limited to, shipping and long term storage. Once these circumstances are over, the fluid expansion receptacles 32 are removed and pens 14 are installed so as to convert the apparatus 30 into a functioning printing system.

Although not required, there can be one expansion receptacle 32 for each pen 14 to provide a one-for-one replacement. Thus, the apparatus 30 of FIG. 2 is shown as having three expansion receptacles 32. However, it should be noted that the present invention is not limited to printing systems having six fluid containers 22 and three inkjet pens 14; it can be used with printing systems having any number of fluid containers and pens, including an equal number of containers and pens. Furthermore, the present invention is not limited to inkjet printing systems and can be implemented with a wide variety of printing systems.

Turning to FIGS. 3-6, one embodiment of a fluid expansion receptacle 32 is shown. This fluid expansion receptacle 32 includes a housing 34 that defines two internal chambers 36. The housing 34, which can be made of any suitable material, has four side walls 38, 40, 42, 44, a bottom wall or base 46, and an open top. Each one of the four side walls 38, 40, 42, 44 is joined at right angles along its lateral edges to adjacent side walls and along its lower edge to a corresponding edge of the base 46. While the housing 34 is shown as having a rectangular cross-sectional shape, such configuration should not be interpreted as limiting. Any number of housing shapes may be utilized. The housing 34 includes a divider wall 48 extending between opposing side walls 38 and 42 so as to separate the interior of the housing 34 into the two chambers 36. The divider wall 48 has a slot 50 formed therethrough from top to bottom and approximately midway between the opposing side walls 38 and 42. The slot 50 receives a locking tab 52, which is capable of sliding longitudinally in the slot 50. The locking tab 52 is a slender, elongated member that extends beyond both ends of the housing 34. An enlargement 54 is formed on the lower end of the locking tab 52.

Figure 5:
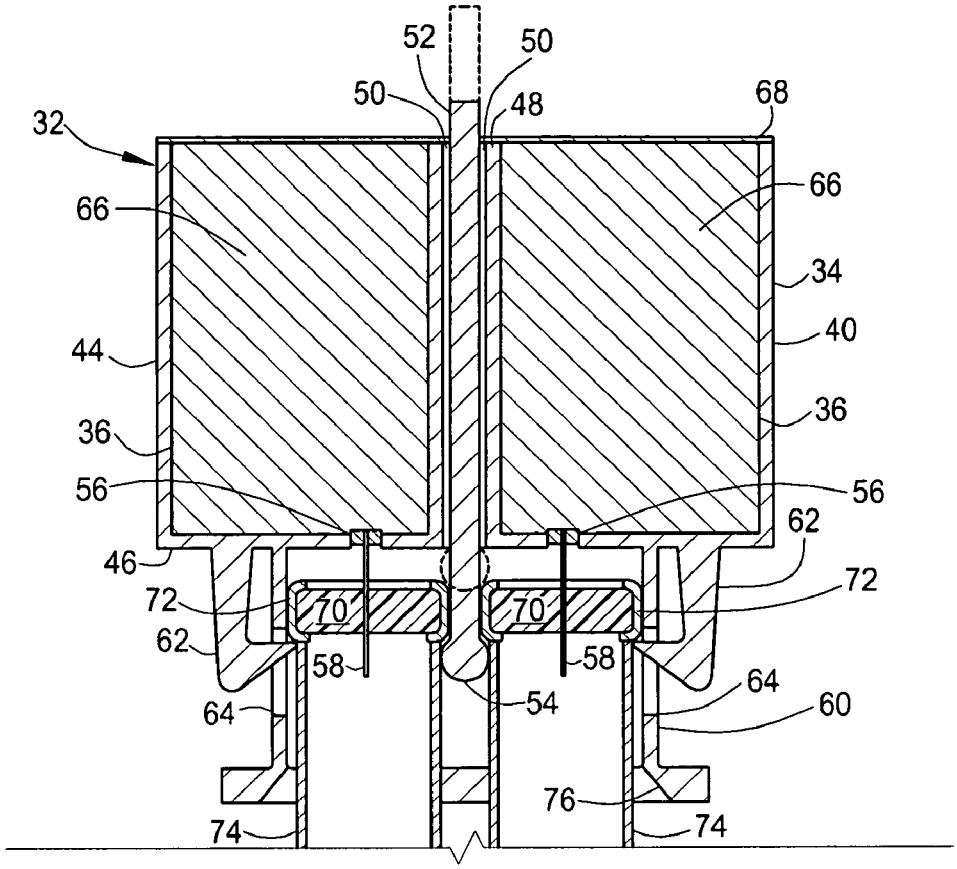
FIG. 5 is a cross-sectional side view of the fluid expansion receptacle, taken along line 5-5 of FIG. 4, showing the fluid expansion receptacle connected to a fluid delivery system.
Figure 6:
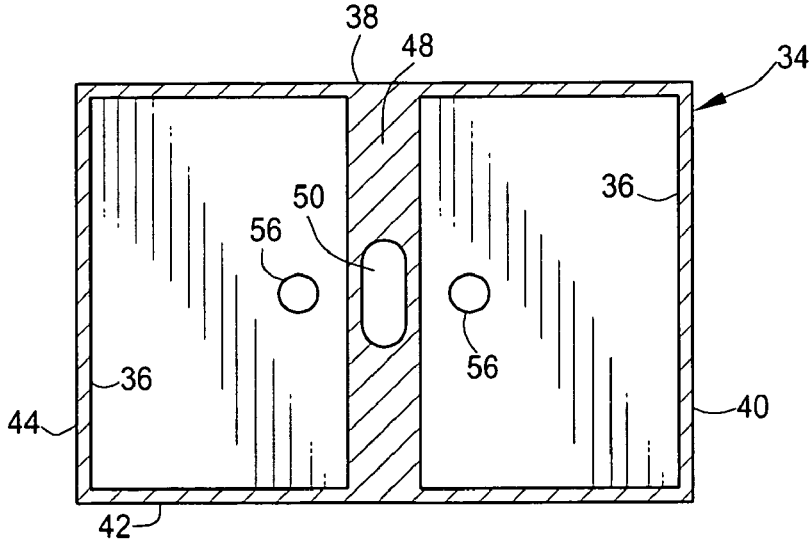
FIG. 6 is a top view of a housing from the fluid expansion receptacle of FIG. 3.
Figure 7:
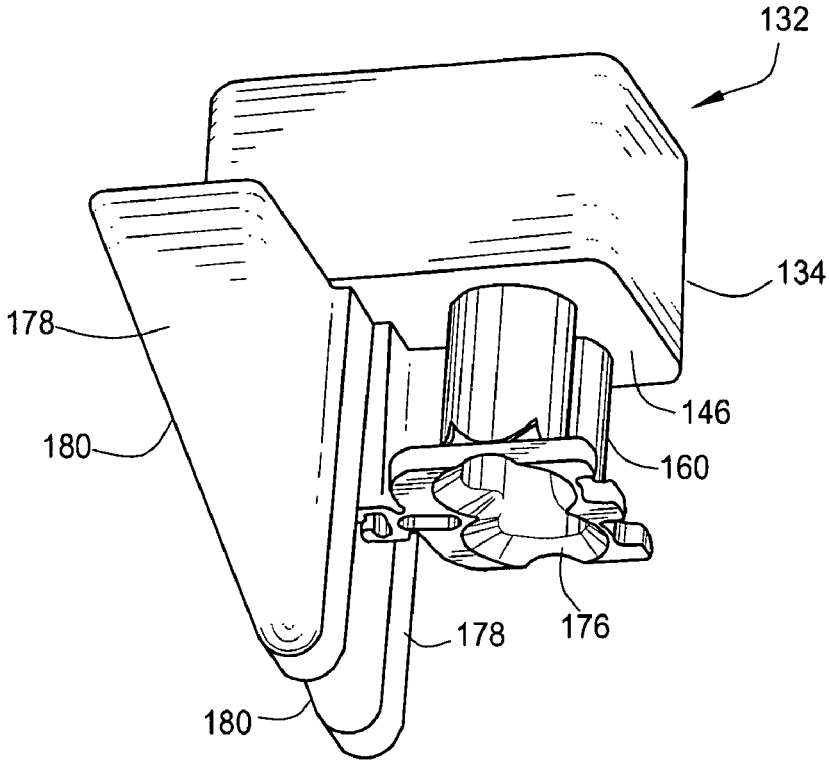
FIG. 7 is a perspective view of another embodiment of a fluid expansion receptacle.
Figure 8:
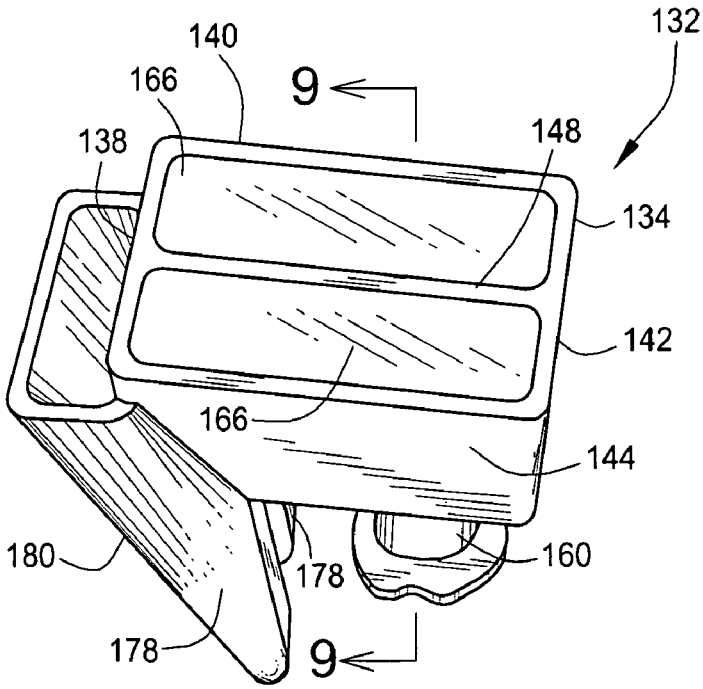
FIG. 8 is another perspective view of the fluid expansion receptacle of FIG. 7.

The housing 34 includes two access holes 56 formed through the base 46 on either side of the divider wall 48 so that each access hole 56 is associated with a respective one of the chambers 36. As best seen in FIG. 5, a hollow needle 58 is mounted in each access hole 56 so as to extend outwardly from the base 46. A shroud 60 is formed on the base 46 so as to surround the needles 58. The shroud 60 protects the needles 58 from inadvertent contact and also helps with alignment when installing the fluid expansion receptacle 32. Two retention hooks 62 are also formed on the underside of the base 46 and extend outwardly therefrom. The retention hooks 62 are located adjacent to the shroud 60, on opposite sides thereof. A slot 64 is formed in each side of the shroud 60 for receiving the tips of the retention hooks 62.

Preferably, although not necessarily, each of the two chambers 36 is filled with a fluid absorbing material 66, such as foam. The fluid absorbing material 66 captures printing fluid that is received in the chambers 36 so as to prevent leakage of such printing fluid from the fluid expansion receptacle 32. A film 68 attached to the top surface of the housing 34 retains the fluid absorbing material 66 in the chambers 36 and prevents captured printing fluid from wicking out of the fluid expansion receptacle 32. The film 68 can be attached in any suitable manner, such as heat staking.

FIG. 5 shows a fluid connection between the fluid expansion receptacle 32 and the fluid delivery system 17, wherein a fluid communication path is established between each chamber 36 and the respective fluid containers 22. In the illustrated embodiment, there are two fluidic interconnects associated with each fluid expansion receptacle 32. Each fluidic interconnect includes a septum 70 that is made of a resilient material such as rubber and has a self-sealing slit formed therein. Each septum 70 is retained in a ring or cap 72 that is crimped over the septum 70. The cap 72 is mounted to a septum bushing 74, which is fluidly connected to a respective one of the supply tubes 20 (not shown in FIG. 5). When a fluid expansion receptacle 32 is installed in one of the receiving stations of the carriage 12 in place of an inkjet pen, the shroud 60 fits over or encloses the two septa caps 72 associated with the receiving station, and the hollow needles 58 are inserted through the self-sealing slits formed in the respective septa 70. The shroud 60 is provided with an inner conical portion 76 to facilitate receipt of the septa caps 72 and to align the septa 70 with the needles 58.

With the fluid expansion receptacle 32 so installed, a fluid communication path is established between each chamber 36 and its respective fluid containers 22 via the supply tube 20, the bushing 74, and the needle 58. Printing fluid is thus able to freely expand from the fluid delivery system 17 into the chambers 36. If the apparatus 30 is exposed to freezing temperatures such that the printing fluid freezes, the fluid expands into the chambers 36 and does not damage the fluid delivery system 17. The chambers 36 should be sized to provide sufficient volumetric compliance for this purpose. The amount of volumetric compliance needed depends on the volume capacity of the fluid delivery system 17.

When the fluid expansion receptacle 32 is installed in the manner described above, the retention hooks 62 engage the lower lips formed by the septa caps 72 to hold the fluid expansion receptacle 32 in position. The locking tab 52 can be moved from a retracted position (shown in dotted lines in FIG. 5) to a deployed position (shown in dotted lines in FIG. 5) so that the enlargement 54 engages the lower lips of the septa caps 72 between the two caps 72 to further secure the fluid expansion receptacle 32 in position. This fastening prevents the fluid expansion receptacles 32 from being unintentionally dislodged by the forces exerted thereon by freezing printing fluid. When a user intentionally removes a fluid expansion receptacle 32 from the receiving station, the needles 58 are extracted from the septa 70 and the self-sealing slits re-seal due to the resiliency of the septa 70.

Referring to FIGS. 7-10, another embodiment of a fluid expansion receptacle 132 is shown. Like that the fluid expansion receptacle of the first embodiment, the fluid expansion receptacle 132 can be used to replace the inkjet pens of a printing system to form an apparatus 30 such as that shown in FIG. 2. The fluid expansion receptacle 132 includes a housing 134 that defines two internal chambers 136. The housing 134, which can be made of any suitable material, has four side walls 138, 140, 142, 144, a bottom wall or base 146, and an open top. Each one of the four side walls 138, 140, 142, 144 is joined at right angles along its lateral edges to adjacent side walls and along its lower edge to a corresponding edge of the base 146. While the housing 134 is shown as having a rectangular cross-sectional shape, such configuration should not be interpreted as limiting. Any number of housing shapes may be utilized. The housing 134 includes a divider wall 148 extending between opposing side walls 138 and 142 so as to separate the interior of the housing 134 into the two chambers 136.

Figure 9:
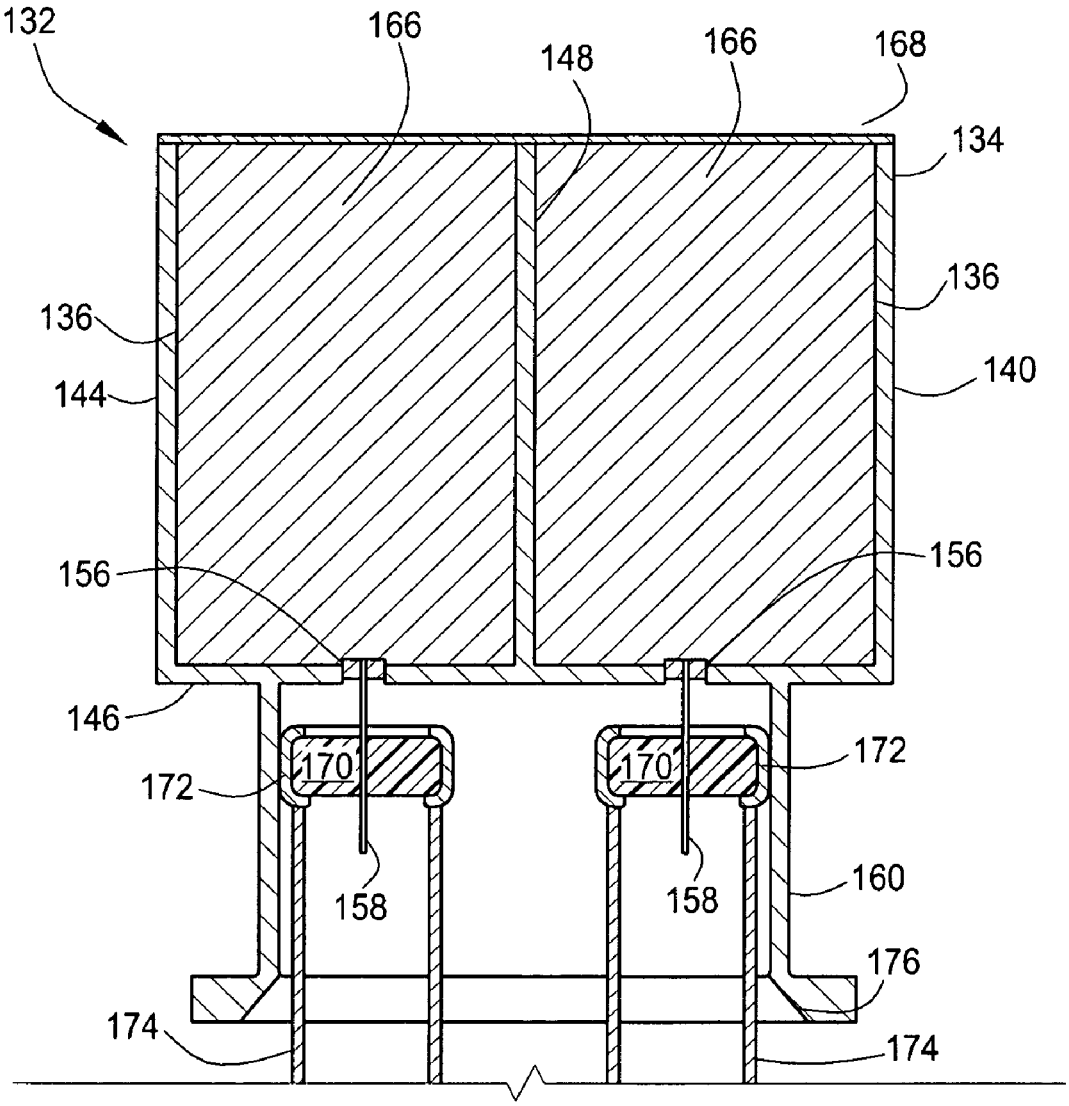
FIG. 9 is a cross-sectional side view of the fluid expansion receptacle, taken along line 9-9 of FIG. 8, showing the fluid expansion receptacle connected to a fluid delivery system.

The housing 134 includes two access holes 156 formed through the base 146 on either side of the divider wall 148 so that each access hole 156 is associated with a respective one of the chambers 136. As best seen in FIG. 9, a hollow needle 158 is mounted in each access hole 156 so as to extend outwardly from the base 146. A shroud 160 is formed on the base 146 so as to surround the needles 158. The shroud 160 protects the needles 158 from inadvertent contact and also helps with alignment when installing the fluid expansion receptacle 132. The housing 134 further includes two locating flanges 178 extending outwardly from the base 146. The locating flanges 178 are situated on the lower rear corners of the housing 134, behind the shroud 160. Each locating flange 178 has a substantially triangular shape so as to define a rearward-facing, sloped abutment surface 180.

Preferably, although not necessarily, each of the two chambers 136 is filled with a fluid absorbing material 166, such as foam. The fluid absorbing material 166 captures printing fluid that is received in the chambers 136 so as to prevent leakage of such printing fluid from the fluid expansion receptacle 132. A film 168 attached to the top surface of the housing 134 retains the fluid absorbing material 166 in the chambers 136 and prevents captured printing fluid from wicking out of the fluid expansion receptacle 132. The film 168 can be attached in any suitable manner, such as heat staking.

FIG. 9 shows a fluid connection between the fluid expansion receptacle 132 and the fluid delivery system 17, wherein a fluid communication path is established between each chamber 136 and the respective fluid containers 22. In the illustrated embodiment, there are two fluidic interconnects associated with each fluid expansion receptacle 132. Each fluidic interconnect includes a septum 170 that is made of a resilient material such as rubber and has a self-sealing slit formed therein. Each septum 170 is retained in a ring or cap 172 that is crimped over the septum 170. The cap 172 is mounted to a septum bushing 174, which is fluidly connected to a respective one of the supply tubes 20 (not shown in FIG. 9). When a fluid expansion receptacle 132 is installed in one of the receiving stations of the carriage 12 in place of an inkjet pen, the shroud 160 fits over or encloses the two septa caps 172 associated with the receiving station, and the hollow needles 158 are inserted through the self-sealing slits formed in the respective septa 170. The shroud 160 is provided with an inner conical portion 176 to facilitate receipt of the septa caps 172 and to align the septa 170 with the needles 158.

Figure 10:
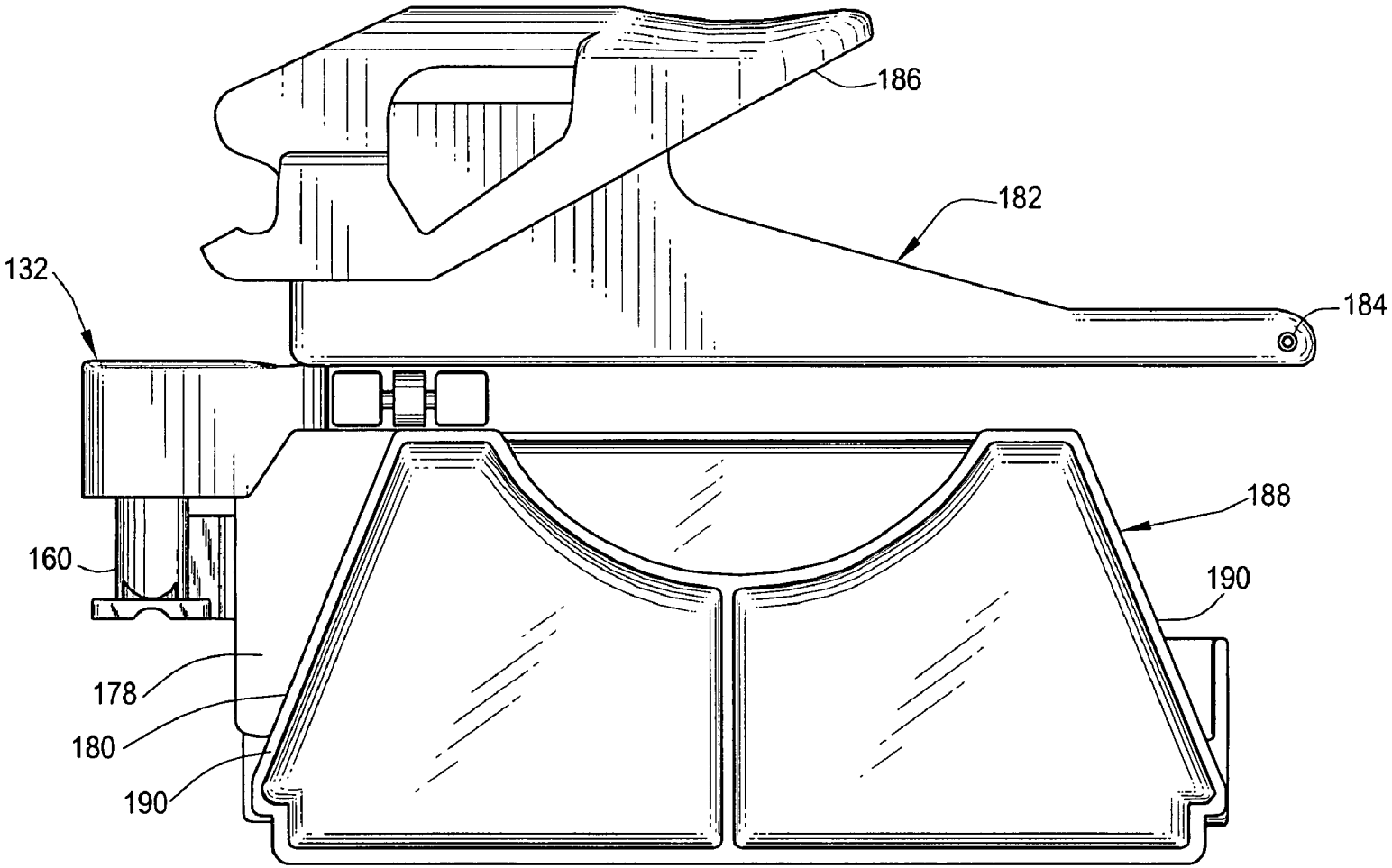
FIG. 10 is a side view of the fluid expansion receptacle of FIG. 7, shown locked in position.

This fluid expansion receptacle 132 is used in conjunction with printing systems in which the carriage 12 is provided with one or more pen latches. A pen latch is a conventional element used in many printing systems that is pivotally attached to the carriage and is ordinarily used to latch one or more inkjet pens in place in the carriage receiving stations. FIG. 10 shows the fluid receptacle 132 secured in position with a pen latch 182. In this case, the pen latch 182 is pivotally connected to the carriage (not shown in FIG. 10) at pivot point 184. By operating the handle 186, the pen latch 182 can be locked into a latching position as shown in FIG. 10. The pen latch 182 can also be opened into a release position by pulling up on the handle 186. To secure the fluid expansion receptacle 132, a pocket shipping restraint 188 having sloped side edges 190 is first placed into the receiving station of the carriage. The pocket shipping restraint 188 is designed to fit into the receiving station and take up the load an inkjet pen would normally receive. The fluid expansion receptacle 132 is then placed into the receiving station so that the abutment surfaces 180 of the flanges 178 engage the appropriate side edge 190 of the pocket shipping restraint 188. The fluid expansion receptacle 132 is thus aligned with the fluid delivery system 17 (not shown in FIG. 10). The pen latch 182 is then locked into its latching position so that the fluid expansion receptacle 132 is locked into position between the pen latch 182 and the pocket shipping restraint 188.

With the fluid expansion receptacle 32 installed in the manner described above, a fluid communication path is established between each chamber 136 and its respective fluid container 22 via the supply tube 20, the bushing 174, and the needle 158. Printing fluid is thus able to freely expand from the fluid delivery system 17 into the chambers 136. If the apparatus 30 is exposed to freezing temperatures such that the printing fluid freezes, the fluid expands into the chambers 136 and does not damage the fluid delivery system 17. The chambers 136 should be sized to provide sufficient volumetric compliance for this purpose. The amount of volumetric compliance needed depends on the volume capacity of the fluid delivery system 17. The pen latch 182 prevents the fluid expansion receptacles 132 from being unintentionally dislodged by the forces exerted thereon by freezing printing fluid. When a user intentionally removes a fluid expansion receptacle 132 from the receiving station, the needles 158 are extracted from the septa 170 and the self-sealing slits re-seal due to the resiliency of the septa 170.

While the illustrated embodiments show two fluidic interconnects per fluid expansion receptacle and receiving station, it should be noted that the present invention is not so limited. For example, there could be only one fluidic interconnect per fluid expansion receptacle and receiving station. In this case, the fluid expansion receptacles would have a single chamber rather than two. Such an arrangement could be implemented with printing systems having one inkjet pen for every fluid container.

While specific embodiments of the present invention have been described, it will be apparent to those skilled in the art that various modifications thereto can be made without departing from the spirit and scope of the invention as defined in the appended claims.

What is claimed is:

1. A printing system comprising:

a fluid supply station holding a plurality of printing fluid containers each containing a printing fluid;

a carriage having a plurality of receiving stations for supporting a corresponding plurality of inkjet pens, each receiving station in fluid communication with a printing fluid container;

a media transport assembly positioned relative to said carriage so as to define a print zone adjacent to inkjet pens supported in said receiving stations;

a print controller electrically connected to said fluid supply station, said carriage and said media transport assembly; and a plurality of fluid expansion receptacles each removably supported in a receiving station on said carriage in place of an inkjet pen, each said receptacle having a chamber therein into which fluid from a printing fluid container may expand to prevent damage to said fluid supply container.

2. the printing system of claim 1 farther comprising:

a conduit having an upstream part connected to the ink supply and a downstream part connected to the receiving station, said fluid expansion receptacle having a chamber therein connected to the downstream part of the conduit so that ink in said ink supply may expand into said chamber through said conduit.

3. The printing system of claim 2 further comprising a shroud surrounding said needle.

4. The printing system of claim 1 further comprising a fluid absorbing material in said chamber.

5. The printing system of claim 1 wherein said fluid expansion receptacle includes a hollow needle extending outwardly therefrom and in fluid communication with said chamber.

6. The printing system of claim 5 further comprising a locking tab slidingly mounted in said fluid expansion receptacle.

7. The printing system of claim 1 wherein said fluid expansion receptacle includes retention hooks for holding said fluid expansion receptacle in said receiving station.

8. The printing system of claim 1 wherein said fluid expansion receptacle defines a second chamber fluidly isolated from the first chamber and in fluid communication with said fluid delivery system so that fluid from said fluid delivery system is able to expand into said second chamber.

9. An apparatus comprising:

a printing system having a fluid delivery system and a receiving station for normally holding an inkjet pen fluidly connected to said fluid delivery system; and a fluid expansion receptacle mounted in said receiving station in place of an inkjet pen, said fluid expansion receptacle defining a chamber that is in fluid communication with said fluid delivery system so that fluid from said fluid delivery system is able to expand into said chamber.

10. The apparatus of claim 9 further comprising a fluid absorbing material in said chamber.

11. The apparatus of claim 9 wherein said fluid expansion receptacle includes a hollow needle extending outwardly therefrom and in fluid communication with said chamber.

12. The apparatus of claim 11 further comprising a shroud surrounding said needle.

13. The apparatus of claim 9 wherein said fluid expansion receptacle includes retention hooks for holding said fluid expansion receptacle in said receiving station.

14. The apparatus of claim 13 further comprising a locking tab slidingly mounted in said fluid expansion receptacle.

15. The apparatus of claim 9 further comprising a latch capable of holding said fluid expansion receptacle in said receiving station.

16. The apparatus of claim 15 wherein said fluid expansion receptacle includes at least one locating flange for positioning said fluid expansion receptacle in said receiving station.

17. The apparatus of claim 16 further comprising a restraint member positioned in said receiving station, wherein said locating flange abuts said restraint member.

18. The apparatus of claim 9 wherein said fluid expansion receptacle defines a second chamber that is also in fluid communication with said fluid delivery system so that fluid from said fluid delivery system is able to expand into said second chamber.

19. The apparatus of claim 18, wherein the second chamber is fluidly isolated from the first chamber.

20. The apparatus of claim 9 further comprising:

a conduit having an upstream part connected to the ink supply and a downstream part connected to the receiving station, said fluid expansion receptacle having a chamber therein connected to the downstream part of the conduit so that ink in said ink supply may expand into said chamber through said conduit.

* * * * *

UNITED STATES PATENT AND TRADEMARK OFFICE

CERTIFICATE OF CORRECTION

PATENT NO. : 7,618,132 B2
APPLICATION NO. : 11/364636
DATED : November 17, 2009
INVENTOR(S) : Rhonda L. Wilson et al.

It is certified that error appears in the above-identified patent and that said Letters Patent is hereby corrected as shown below:

In column 7, line 35, in Claim 2, delete "the" and insert -- The --, therefor.

In column 7, line 35, in Claim 2, delete "farther" and insert -- further --, therefor.

Signed and Sealed this

Sixteenth Day of February, 2010

David J. Kappos

David J. Kappos
*Director of the United States Patent and Trademark Office*